United States Patent [19]

Streicher

[11] 3,932,175

[45] Jan. 13, 1976

[54] CHROMIUM, MOLYBDENUM FERRITIC STAINLESS STEELS

[75] Inventor: Michael A. Streicher, Wilmington, Del.

[73] Assignee: E. I. Du Pont de Nemours and Company, Wilmington, Del.

[22] Filed: Mar. 9, 1971

[21] Appl. No.: 122,529

Related U.S. Application Data

[63] Continuation-in-part of Ser. No. 46,428, June 15, 1970.

[52] U.S. Cl. ..... 75/126 C

[51] Int. Cl.[2] ..... C22C 38/22

[58] Field of Search ..... 75/126 C

[56] References Cited

UNITED STATES PATENTS

| | | | |
|---|---|---|---|
| 2,183,715 | 12/1939 | Franks | 75/126 C |
| 2,220,690 | 11/1940 | Stupakoff | 75/126 R |
| 2,274,999 | 3/1942 | Allen | 75/126 C |
| 2,624,671 | 1/1953 | Binder | 75/126 C |

*Primary Examiner*—L. Dewayne Rutledge
*Assistant Examiner*—Arthur J. Steiner

[57] ABSTRACT

A ferritic alloy containing, in general ranges, 22–35% chromium, 1.8–6.2% molybdenum, 100 ppm carbon maximum, 200 ppm nitrogen maximum, the sum of carbon plus nitrogen being 250 ppm maximum, having inherent post-welding ductility and high corrosion resistance.

8 Claims, 2 Drawing Figures

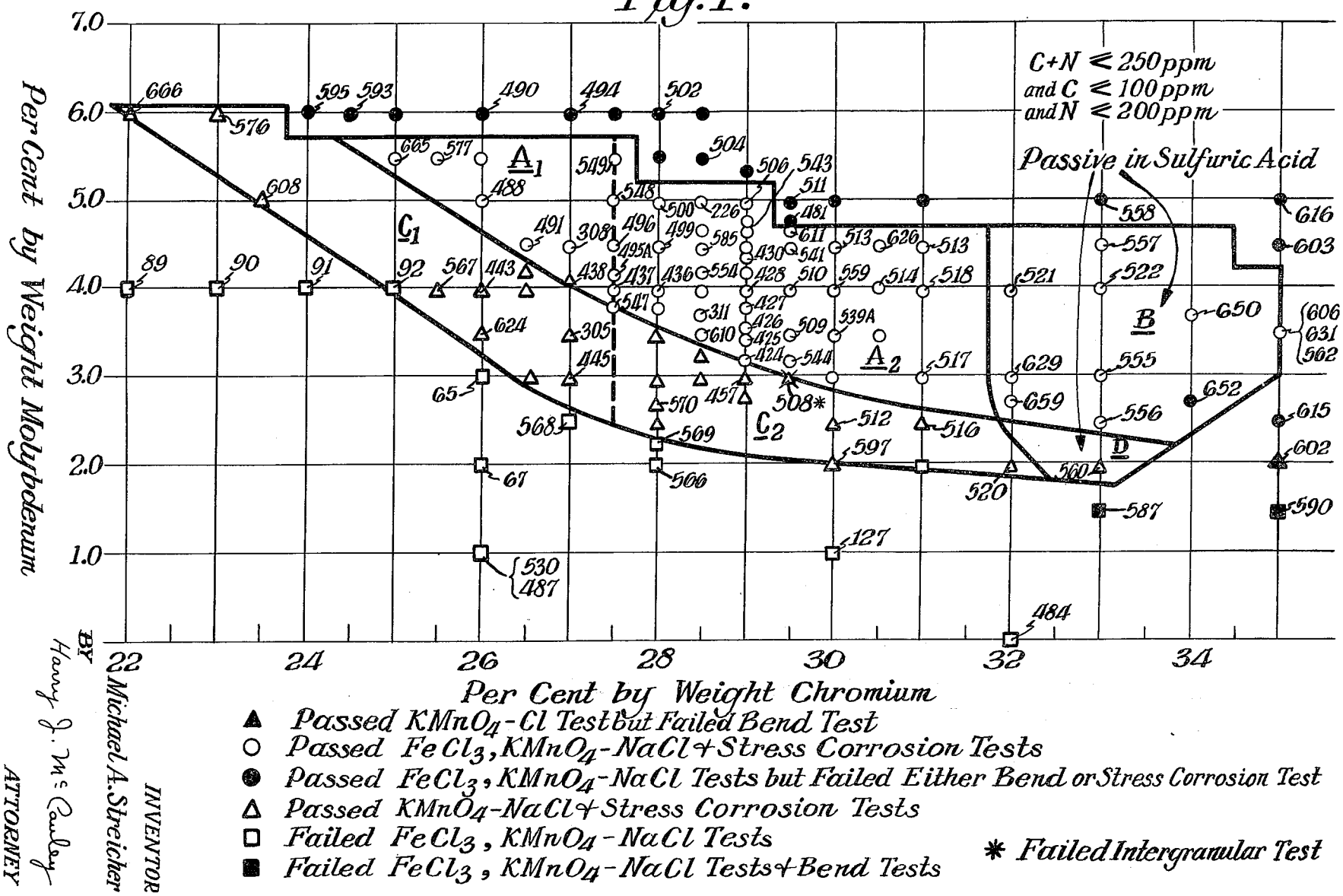
INVENTOR
Michael A. Streicher
BY
Harry J. McCauley
ATTORNEY

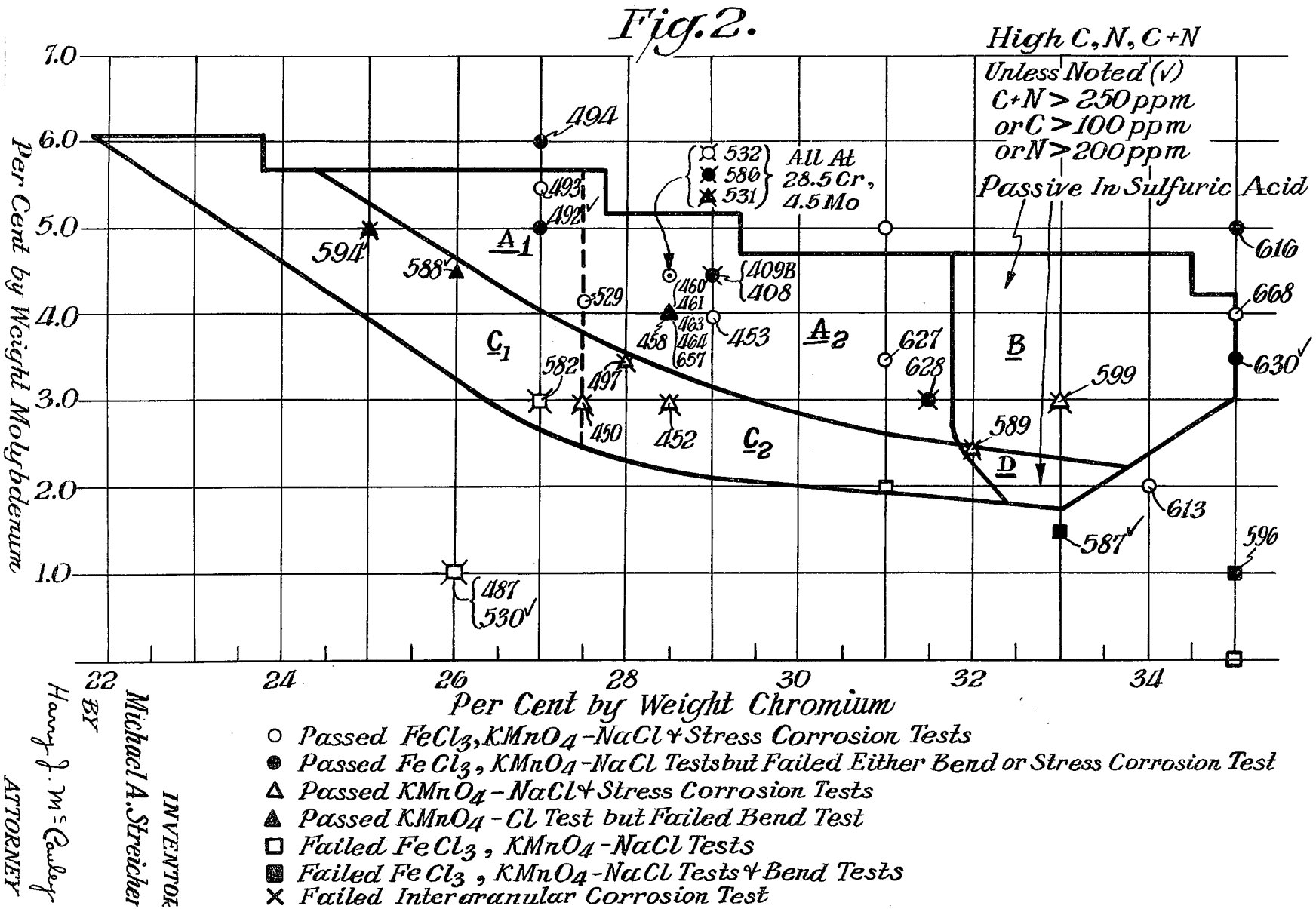
INVENTOR
Michael A. Streicher
BY
Harry J. McCauley
ATTORNEY

CHROMIUM, MOLYBDENUM FERRITIC STAINLESS STEELS

CROSS REFERENCE TO RELATED APPLICATION

This application is a continuation-in-part of U.S. application Ser. No. 46,428 filed June 15, 1970.

BRIEF SUMMARY OF THE INVENTION

Generally, this invention comprises a corrosion-resistant especially pitting-resistant ferritic alloy having good post-welding ductility containing, as principal alloying elements, chromium and molybdenum in the combinations lying within areas $A_1$, $A_2$, B, $C_1$, $C_2$ and D of FIG. 1 of this Application, carbon 100 ppm maximum, nitrogen 200 ppm maximum, and carbon plus nitrogen 250 ppm maximum, the remainder being iron and incidental impurities.

The essential components of the alloys of this invention are Fe, Cr, Mo and certain metal additives hereinafter identified. As in all alloys of the class involved, there may also be present incidental impurities. In commercial practice these might consist of the following, in the approximate weight percentages reported: S 0.010%, P 0.010% (together with, typically, 0.80% Mn and 0.50% Si as deliberate additions).

DRAWINGS

The following drawings present the essential requirements in terms of percent chromium as abscissa and percent molybdenum as ordinate together with the permissible carbon and nitrogen contents required according to this invention, in which:

FIG. 1 is a plot of four different regions of different corrosion resistance and postweld ductility for alloys containing C equal to or below 100 ppm, N equal to or below 200 ppm, and C+N equal to or below 250 ppm, and FIG. 2 is an overlay of the same regions of corrosion resistance and postweld ductility as FIG. 1 within which are plotted typical ferritic Cr, Mo alloy compositions matching those of FIG. 1, except that the C content is above 100 ppm, or the N content is above 200 ppm, or C+N is above 250 ppm.

In the early development of the stainless steels, chromium steels containing 12–14% Cr and 1–4% were the first, large-volume products. Attempts were soon made (Br. Pat. No. 18,212 accepted on July 9, 1914) to improve the corrosion resistance properties by the addition of molybdenum; however, it was noted that molybdenum, when applied in sufficient quantity to make the alloy passive, also made it too hard and brittle. Brittleness contributed by Mo addition was confirmed by Reitz et al. in U.S. Pat. Nos. 2,110,891 and 2,207,554. Franks Patent 2,183,715 taught additions of 1–5% of Mo to iron, chromium alloys but found this addition insufficient to overcome even his mild service exposures and recommended the addition to niobium to the extent of four times the carbon content, at least, to overcome his problems of pitting corrosion. Finally, Moneypenny, in *Stainless Iron and Steel*, Vol. 1, Chapman & Hall, London, 1947, p. 48, reported certain contemporaneous work done in Germany to improve the usefulness of iron chromium alloys by adding about 2% Mo to them. While resistance to corrosion by a number of organic acids and other compounds was reported to be markedly increased, especially at Cr contents above about 18%, the mechanical properties were not improved. Thus, the alloys were classed as notch-brittle and subject to marked grain growth when heated to high temperatures, as, for example, during welding.

It has been generally recognized, up to this date, that Fe, Cr alloys as a class develop a high degree of brittleness in or adjacent to welds, and this inadequacy has severely limited uses of the alloys containing more than about 20% Cr wherever welding is essential as, for example, in the manufacture of chemical processing and other vessels, pipes and similar equipment.

Early investigators were able to reduce the impact brittleness of ferritic chromium alloys by limiting combined carbon and nitrogen contents to about 0.023% maximum, as reported in U.S. Pat. No. 2,624,671; however, marked post-welding brittleness persisted and, in U.S. Pat. No. 2,624,670, it was reported necessary to convert the alloys to at least a partially austenitic state in order to cure the difficulty. Bue austenitic alloys are subject to chloride stress-corrosion cracking, and so one valuable attribute was lost in the acquisition of another. Moreover, these investigators deemed it necessary to heat treat by annealing at 900°C., followed by rapid quenching, in order to minimize brittleness in weldments, and this is an exceedingly troublesome and expensive expedient.

Corrosion is an extremely complex combination of phenomena constituting numerous well-recognized types. To detect and overcome susceptibility to the individual types of corrosion requires individually designed techniques for each. It is also not generally true that a material resistant to one form of corrosion is resistant also to others. For example, a nickel-bearing stainless steel may be highly resistant to nitric acid, and yet prone to disastrous cracking when exposed under stress to chloride environments.

The alloys of this invention have been developed to resist exposures to a wide variety of corrosive environments, while still having high post-weld ductility and good economy in the fabrication.

Important types of corrosion include the following:

1. Pitting corrosion in halide environments
   a. Extreme exposure, as in oxidizing chloride environments, e.g., 10% $FeCl_3 \cdot 6\ H_2O$ at 50°C., accentuated by crevices,
   b. Severe exposure, as in chloride waters containing permanganate ions at 90°C.,
2. Intergranular corrosion in acid and chloride environments
3. Stress-corrosion cracking in chloride-containing environments
4. General surface corrosion
   a. Organic acids, such as sulfamic, formic, acetic, and oxalic acids,
   b. Oxidizing acids, such as 65% nitric,
   c. Inorganic reducing acids, such as boiling 10% sulfuric.

(This latter category can best be appraised in three different aspects:

(I) Active alloys, which are active at once, or within a few hours, these dissolving at rates in excess of 50,000 mils per year, (II) Passive alloys, which are passive upon immersion in the corrosive media, dissolving relatively uniformly therein at rates less than 100 mils/yr. These alloys become activated when contacted with an activating electrode and remain active when contact is broken, and (III) Self-repassivating alloys, which are passive upon immersion, become active when in contact with a galvanically activating electrode, but become passive again on the electrode's removal.)

My invention constitutes an improved pitting resistant ferritic chromium, molybdenum alloy in which, by close and critical control of chromium content, interrelated molybdenum content, and limited carbon and nitrogen contents, there is obtained an enhanced environmental breadth of very high corrosion resistance coupled with high post-welding ductility. In yet other embodiments of this invention, additional ingredients provide even better specific corrosion resistance properties.

A. SPECIMEN PREPARATION

1. Ingredients

All specimens were prepared by the technique hereinafter described, using high purity ingredients as detailed in Table I:

TABLE I

| Ingredient | Supplier | Analysis |
|---|---|---|
| Iron | Glidden Co. | 99.91% Fe, C 20 ppm, N 40 ppm |
| Chromium | Union Carbide Corp. | 99.95% Cr, 0.01% Fe, C 50 ppm, N 60 ppm |
| Chromium | Shieldalloy Corp. | 98.2% Cr, C 85 ppm, N 284 ppm |
| Molybdenum | Fansteel Co. | 99.9% Mo, C 20 ppm, N 10 ppm |
| Molybdenum | Climax Molybdenum | 99.7% Mo, C 32 ppm, N 12 ppm |

Where nickel was utilized, the ribbon form was employed. Silicon was reagent grade, aluminum was in lump form analyzing 99.992% Al, carbon was of High Purity lump grade, free of filler or in the form of high carbon ferro-chrome alloy, and nitrogen was supplied as $Cr_2N$ powder.

2. Melting

The alloying ingredients were melted in high purity alumina crucibles in a vacuum induction furnace, which was sealed and evacuated to $10^{-3}$ to $10^{-5}$ Torr before the power was switched on. The powder was increased gradually to minimize thermal shock and, when melting was incipient, the furnace was filled with gettered argon (a purified commercial grade of argon especially low in oxygen and nitrogen content) to an absolute pressure of 5 inches Hg in order to inhibit vaporization of the alloying ingredients. At the completion of the melting operation, the heat was cast through a fire brick funnel into a vertically disposed cylindrical copper mold placed in the argon atmosphere. After cooling, the ingot was removed and the hot top containing the shrinkage cavity was cut off.

3. Heat Treatment and Working

Each ingot was soaked for 3 hours at 2200°F. in an electric furnace (air atmosphere) and then forged to a rectangular cross section.

The forged ingot was then reheated to 2150°F. and rolled to a thickness of 100 mils in light passes, interspersed with four reheats to 2150°F., each requiring about 10 mins.

After the final rolling, the sheet was heated at 2000°F. for one hour and water-quenched. Alloys containing titanium as a stabilizing additive were given a lower final heat treatment of 2 hours at 1750°F.

Specimens subjected to corrosion, mechanical and analytical tests were cut with a power saw and were thereafter ground to an 80 grit finish using a water-cooled silicon carbide belt.

4. Welding

To investigate the effects of welding on corrosion resistance and on mechanical properties, autogenous welds were made as follows:

Welded samples for bend and stress corrosion tests measured approximately 3 long X 1 wide by 0.1 inch thick, and these were given a lengthwise fusion weld using the argon gas-tungsten arc welding process and an energy input per pass of approximately 16,000 joules/inch [the energy input per pass in joules/inch = arc voltage (volts) x arc current (amperes)/torch travel speed, in./sec.] During the welding, the back of the sample was concurrently shielded with argon, to reduce oxidization and safeguard against pickup 119 of nitrogen. In further explanation, there was no fusion of two pieces of alloy here, the electrode simply being given a single pass longituudinally of the sample piece. During this pass, the energy input was sufficient to melt the metal in the immediate region of the electrode traverse for almost the entire thickness of the sample and for a width of approximately ¼ inch. The specimens were then allowed to cool in the air to room temperature, thereby duplicating usual welding practice.

Three specific sample regions are of particular interest in tests hereinafter reported, these being the visually apparent weld zone, where the torch had melted the surface metal, the remote base-plate zone (abbreviated BP), which is all metal ½ inch or more away from the weld, and the intervening heat-affected zone (HAZ).

5. Analyses

The data hereinafter reported, and plotted in FIGS. 1 and 2, are based on "weighed out" proportions of iron, chromium and molybdenum. Confidence in this approach has been provided by a weight balance established by weighing cast ingots and rolled sheets made from these ingots and comparing the results with the total weight of the metals charged in making the alloys. The average detectable change in weight between the weighed-in ingredients, the ingots and the rolled sheets amounted to only 0.1 gm out of a total weight of 400 gms. Additional confidence in the practice arises from the consistency and sharp definition of the pitting test results plotted in the FIGURES.

Carbon was determined by combustion with a Leco Carbon Analyzer. Nitrogen analyses were made by the micro Kjeldahl method using Nessler's Reagent.

Titanium, niobium and aluminum were determined by X-ray fluorescence.

B. ALLOY TESTING

1. Pitting Corrosion: Potassium Permanganate-Sodium Chloride Test

This is a new test applied by applicant to simulate chloride pitting in severely corrosive natural waters, such as Ohio River water used in heat exchangers. Such waters contain some manganese and must be chlorinated to prevent the accumulation of organic slime in the heat exchangers. A propensity towards severe pitting attack results, probably due to the conversion of tetravalent, insoluble manganese to soluble permanganate ($Mn^{+7}$) by chlorine and the simultaneous reduction of chlorine to chloride ($Cl^-$) ions.

Service tests at plant locations require relatively large amounts of material and 6–18 month test exposures for alloy evaluation, so that this accelerated test was developed as a substitute.

A 2% $KMnO_4$–2% NaCl water solution with pH adjusted to 7.5 was employed. Large test tubes 11½ long X 11/2 inches dia. containing 150 ml of the test solution were immersed in a 90°C. thermostatically controlled water bath. (The 90°C. temperature was selected to simulate conditions in heat exchangers.) The test tubes were covered with a rubber stopper fitted with a glass tube for venting, and the specimens placed therein were 1 × 2 × 0.08 inch thick pieces ground to an 80 grit finish.

Pitting attack in the solution is evidenced by extensive formation of a surface coating of insoluble manganese oxides. It appears that, as the alloy dissolves at anodic sites (pits), insoluble manganese oxide is precipitated at the unpitted cathodic areas where permanganate ions are reduced to the tetravalent state in an electrochemically equivalent reaction.

The coating is removed at room temperature without attack on the metal by immersion of the specimen in a solution disclosed in applicant's U.S. Pat. No. 3,481,882, consisting of: 900 ml $H_2O$, 27.4 ml 96.5% $H_2SO_4$, 14.4g oxalic acid, 0.2g Alkanol WXN and 0.2g diorthotolylthiourea. The cleaned specimen clearly reveals evidence of pitting attack to the unaided eye.

Only specimens which were free of all pitting attack, and of manganese oxide coating, were classified "resistant." Those which displayed any pitting at all were rated "failed." Commercially available ferritic and austenitic stainless steels (e.g., A.I.S.I. 446, 316 and 310) were readily pitted by this solution at room temperature. Generally, specimens resistant to attack for the first 24 hours were found to be resistant for as long as 16 months.

In the tests hereinafter reported, samples resistant to this hot permanganate-chloride test were classified as "highly resistant" and of "high resistance" to pitting corrosion.

2. Pitting Corrosion: Ferric Chloride Test

This test is commonly used when conducted at room temperature; however, applicant chose to accelerate it by elevating the test temperature to 50°C. and by providing tight crevices. As accelerated, this test is more severe than the permanganate-chloride pitting test at 90°C.

The test was conducted in a thermostatically controlled water bath at a temperature of 50°C. using 150 ml of 10% $FeCl_3.6H_2O$ in water in individual 11½ × 1½ inches dia. test tubes vented through tube-fitted rubber stoppers. The unwelded test specimens, ground to 80 grit finish, measured 1 × 2 × 0.08 inch thick. Crevices were created on the edges and surfaces of the specimens by employing polytetrafluoroethylene blocks on the front and back held in position by pairs of rubber bands stretched at 90° to one another in both longitudinal and transverse directions. This created two sharp crevices at top and bottom of the specimen where the longitudinal elastic touched the metal, two somewhat less sharp crevices at the side edges and two crevices under the polymet blocks. Contraction of the elastics provided constant crevice conditions during progressive metal corrosion at the points of contact.

At room temperatures, it was found that, if an alloy pits with a crevice it will eventually also pit without a crevice, but the exposure required to reveal this may be as long as 4 months' duration. In applicant's accelerated test, pitting occurred within 24 hours in the case of alloys susceptible to this type of pitting. Resistant alloys were exposed for weeks, and, in some cases, for as long as 12 months, without any pitting attack.

As hereinafter reported, samples that resisted attack in the hot ferric chloride test were classified as "extremely resistant." Almost all of the same analyses that passed this test had already passed the permanganate-chloride test.

3. Stress Corrosion: Boiling Magnesium Chloride Test

This test, while not yet actually adapted as a standard by the American Society of Testing Materials, is nevertheless already widely utilized. It is conducted in accordance with the procedures described by applicant in association with A. J. Sweet, published in "Corrosion," Vol. 25, No. 1, pp. 1–6 (1969) January.

The test solution is boiling (155°C.) 45% $MgCl_2$. The test specimens were 3 × ¾ inches wide, 80 mil thick, in most cases having a lengthwise autogenous weld, because welded specimens reveal susceptibility to stress corrosion more readily than unwelded specimens. The welded specimens were bent 180° over a 0.336 inch dia. cylindrical mandrel. Stress was applied by tightening a Hastelloy C bolt through holes at each end of the specimen, the bolt being electrically insulated from the specimen by polytetrafluoroethylene bushings.

Austenitic stainless steels fail by cracking in 1–4 hours during exposure to this test. In contrast, it was found that alloys according to this invention did not crack within 100 days of exposure. Alloys which did not fail sooner were routinely left on test for 100 days to demonstrate their immunity to stress corrosion.

The boiling $MgCl_2$ test is a very severe one, not usually encountered in industry. Nevertheless, I have found a correlation between it and the stress corrosion propensity of such Cr- containing alloys as AISI-430 and -446 to cracking in NaCl solutions containing only 50 ppm $Cl^+$. The latter is much more like a simulated service corrosion test; however, test exposures of 250 hours or more are often required to detect corrosion susceptibility. Thus, for ferritic alloys, the $MgCl_2$ test can be considered to be a valid, rapid test for evaluating stress corrosion cracking.

Since preparation of welded stress-corrosion cracking specimens requires cold bending welded specimens transversely of the weld, there was incidentally afforded a severe test of ductility. Some test alloys outside this invention cracked during bending and were therefore not tested in the $MgCl_2$ solution. Consolidated test data are set out in the Table II hereinafter set forth.

4. Intergranular Attack (IGA): Ferric Sulfate-Sulfuric Acid Test

To detect susceptibility to intergranular attack (hereinafter abbreviated IGA), welded specimens were exposed for 120 hours to boiling 50% $H_2SO_4$ containing 41.6 gm/l $Fe_2(SO_4)_3$. X $H_2O$. This rapid test was originally developed by applicant for austenitic stainless steels (M. A. Streicher, ASTM Bulletin No. 229, pg. 77 (1958) April, and ASTM-A262–68 "Recommended Practice for Detecting Susceptibility to Intergranular Attack in Stainless Steels"). Applicant's extensive investigation has now established that this test is also valid for the determination of susceptibility to IGA in commercial ferritic stainless steels of the class represented by AISI-430, -446 and of this invention, as a function of heat treatment and Cr, C and N contents.

The test was conducted on specimens ground to 80 grit finish, measuring about 1 × 2 × 0.08 inch thick with an autogenous weld across the width of the specimens. The specimens were immersed in 600 ml of test solution held in a 1 liter Erlenmeyer flask fitted with an Allihn condenser.

Specimens tested were evaluated by both weightloss measurements and, especially, by 80 X microscopic examination for evidence of grain dropping. Three zones were particularly examined for dislodged grains, the base plate (BP), the weld metal (Weld) and the heat-affected zone (HAZ). Any evidence of dislodged grains was cause for rejection of the particular alloy sample. The results are tabulated in Table II.

5. General Corrosion in Acids

As hereinafter set out in Table III, a comparison was made of commercial alloys with alloys within the limits of this invention as regards general corrosion occurring in representative acid environments, including oxidizing, reducing, organic and inorganic. The acids, techniques and data for commercial alloys have been previously published by applicant in "Corrosion", Vol. 14, No. 2, p. 59t–70t, February (1958).

Briefly, all tests were conducted on unwelded specimens measuring 1 × 2 inches × about 80 mils thick, with surfaces ground to an 80-grit finish. Boiling test solutions of 600 ml volume were employed using Erlenmeyer flasks fitted with reflux condensers. Tests showing "astronomical" corrosion rates lasted only 5 minutes, but for samples corroding at less than 100 mils/-year, the tests were prolonged for 100 hours.

Especially significant, as detailed later, is a group of tests utilized to show the development and/or loss of passivity, and the corrosion rate in boiling 10% sulfuric acid.

6. Mechanical Tests

In addition to the bend tests made preliminary to the $MgCl_2$ stress corrosion test of Section B(3) supra, a number of additional mechanical tests were made to obtain a comparison with commercial steels of the same general class and, in any case, to establish critical strength data.

Thus, a tensile test was conducted on alloy Q-202-H made according to this invention, the analysis of which was 28.5% Cr, 4.0% Mo, C 23 ppm, N 130 ppm. The results, as compared with commercial steels having properties tabulated in the "Stainless Steel Handbook" published by the Allegheny Ludlum Steel Corp., pp. 2–5 (1951) were as follows:

| Alloy | Yield Stress (psi) | Ultimate Strength (psi) | Elongation (%) |
|---|---|---|---|
| AISI-316 | 30,000 | 75,000 | 40 |
| AISI-430 | 35,000 | 60,000 | 20 |
| AISI-446 | 45,000 | 75,000 | 20 |
| Q-202-H (this invention) | 58,675 | 73,980 | 24 |

From the foregoing, it is seen that the yield stress of my composition is higher than that of commercial alloys, and the elongation is superior to that of commercial ferritic alloys.

Another test conducted was a low temperature bend test transverse the weld for specimens of the following three compositions of this invention on 3 × ¾ × 0.51 to 0.68 inch thick specimens autogenously welded lengthwise and then ground to an 80-grit finish. This test was carried out on an Instron machine using a 0.4 inch dia. mandrel in a controlled temperature chamber.

| Alloy | 75°F. | −25°F. | −50°F. | −75°F. |
|---|---|---|---|---|
| Q-433 [Cr 28.5%, Mo 4.0% C 18 ppm, N 37 ppm] | bent | bent | bent | cracked |
| Q-436 [Cr 28.0%, Mo 4.0% C 28 ppm, N 83 ppm] | bent | — | — | bent |
| Q-437 [Cr 27.5%, Mo 4.0% C 29 ppm,] | bent | — | — | cracked |

Yet another mechanical test was a cold rolling test in which the following alloys of this invention, which had previously been hot-rolled to a thickness of about 100 mils, were cold-rolled to about 25 mils, the limit of the rolls:

| Alloy | Cr(%) | Mo(%) | C(ppm) | N(ppm) | Per Cent Reduction |
|---|---|---|---|---|---|
| Q-120 | 30.0 | 3.0 | — | — | 90 |
| Q-202A | 28.5 | 4.0 | 20 | 25 | 81 |
| Q-562 | 35.0 | 3.5 | 14 | 20 | 69 |
| Q-557 | 33.0 | 4.5 | 28 | 35 | 70 |
| Q-514 | 30.5 | 4.0 | 5 | 170 | 67 |

In every case, there was excellent ductility, i.e., there was no cracking, either at the edges or in the surfaces.

In still another investigation, comparative Charpy impact tests were run on a 29.0% Cr, 4.3% Mo, 25 ppm C, 110 ppm N specimen according to this invention, labeled "Invention" in the tabulation infra, along with AISI-446 and -316 commercial steels.

All Charpy specimens were half-size, i.e., 2.16 × 0.197 × 0.394 inch, with a 45° notch having a 0.010 inch radius. These specimens were machined from ¼ inch thick plates with the root of the notch lying in the rolling direction.

| Alloy | Charpy Impact (ft.-lb.) | Type of Fracture |
|---|---|---|
| AISI-446 | 1.75, 2.0 | Complete and brittle. |
| AISI-316 | 42.75, 47.5 45.0 | Bent, ductile rupture. |
| "Invention" | 44, 51 | Bent, ductile, some intergranular fracture. |

From the foregoing, the Charpy impact values for alloys of this invention were about the same as for AISI-316 and much superior to those of AISI-446.

C. EVALUATION OF Fe-Cr-Mo ALLOYS LIMITED IN C AND N CONTENTS BUT CONTAINING NO OTHER ADDITIVES BEYOND INCIDENTAL IMPURITIES

Referring to FIG. 1, a great number of alloy compositions are plotted which collectively precisely define a number of different regions $A_1$ and $A_2$ (which can, for some purposes, be considered together to be an entity A), B, $C_1$ and $C_2$ (which can, for some purposes, be considered together to be an entity C) and D according to this invention which are characterized by improved corrosion resistance, especially pitting resistance, over the prior art. In addition, these several regions are characterized by different corrosion resistances among themselves generally showing increasing corrosion immunity with increase in both Cr and Mo contents within the overall perimeter enclosing all of the regions.

The vertical division line at 27.5% Cr defining the areas made up of regions $A_1$ and $C_1$ to the left and $A_2$ and $C_2$ to the right can be disregarded in the general consideration of corrosion resistance as to which Table II pertains; however, this dividing line has significance in Section E, infra relating to the effects of other additives.

For purposes of brevity Table II is abridged to report only preselected analyses, segregated by specific FIG. 1 region, or near-peripheral specimens which define the boundaries thereof. The plot points corresponding to representative Alloy Nos. are denoted in FIGs. 1 and 2. Unless specifically noted in the "Remarks," all Alloys were subjected to all of the tests.

TABLE II a. Regions $A_1$ and $A_2$ collectively, characterized by resistance to pitting under exposure to (1) the permanganate-chloride test and (2) the ferric chloride test, (3) resistant to intergranular corrosion attack [IGA] under exposure to the ferric sulfate-sulfuric acid test, (4) ductile in the 180° transverse weld bend test of as-received (unannealed) welded specimens and (5) resistant to stress corrosion [S.C.]

| Alloy No. Region $A_1$ | Composition in Per Cent by Wt. Cr | Cr and Mo, ppm Mo | C and N C | N | Remarks |
|---|---|---|---|---|---|
| 665 | 25.0 | 5.5 | 75 | 150 | Not tested for stress corrosion |
| 438 | 27.0 | 4.0 | 24 | 68 | Passed all 5 tests |
| 577 | 25.5 | 5.5 | 25 | 63 | Test 3 [IGA] omitted |
| 549 | 27.5 | 5.5 | 15 | 195 | Passed all 5 tests |
| 548 | 27.5 | 5.0 | 10 | 5 | Tests Nos. 1 & 3 [IGA] omitted |
| 496 | 27.5 | 4.5 | 31 | 155 | Tests Nos. 1 & 3 [IGA]omitted |
| 489 | 26.0 | 5.5 | 19 | 108 | Test No. 1 ($KMnO_4$-NaCl) omitted |
| 488 | 26.0 | 5.0 | 22 | 110 | Passed all 5 tests |

| Alloy No. Within Region $A_2$ | Composition in Per Cent by Wt. Cr | Cr and Mo, ppm Mo | C and N C | N | Remarks |
|---|---|---|---|---|---|
| 656 | 28.5 | 4.0 | 23 | 100 | Tests 2 and 5 for $FeCl_3$ and stress corrosion, respectively, omitted |
| 611 | 29.5 | 4.7 | 25 | 118 | Tests 3 [IGA] and 5 [S.C.] omitted |
| 610 | 28.5 | 3.5 | 25 | 55 | Tests 1, 3 and 5 omitted |
| 585 | 28.5 | 4.5 | 20 | 93 | Passed all 5 tests |
| 559 | 30.0 | 4.0 | 24 | 150 | Tests 3 [IGA] and 5 [S.C.] omitted |
| 554 | 28.5 | 4.2 | 23 | 17 | Tests 3 [IGA] and 5 [S.C.] omitted |
| 548 | 27.5 | 5.0 | 10 | 5 | Tests 1 and 3 [IGA] omitted |
| 547 | 27.5 | 3.8 | 15 | 5 | Tests 3–5 omitted |
| 544 | 29.5 | 3.2 | 24 | 118 | Tests 3 [IGA] and 5 [S.C.] omitted |
| 543 | 29.0 | 4.7 | 27 | 13 | Test 1 $KMnO_4$-NaCl omitted |
| 541 | 29.5 | 4.5 | 38 | 80 | Tests 1–3, incl., omitted |
| 539A | 30.0 | 3.5 | 15 | 128 | Test 3 [IGA] omitted |
| 538 | 28.5 | 4.5 | 29 | 15 | Passed all 5 tests |
| 537 | 28.5 | 4.5 | 23 | 133 | Passed all 5 tests |
| 518 | 31.0 | 4.0 | 21 | 88 | Tests 1 and 3 [IGA] omitted |
| 517 | 31.0 | 3.0 | 14 | 188 | Test 3 [IGA] omitted |
| 513 | 30.0 | 4.5 | 19 | 150 | Tests 1 and 3 [IGA] omitted |
| 436 | 28.0 | 4.0 | 28 | 83 | Passed all 5 tests and, in addition, was ductile at −75°f. |

| Alloy No. Peripheral | Composition in Per Cent by Wt. Cr | Cr and Mo, ppm Mo | C and N C | N | Remarks |
|---|---|---|---|---|---|
| Analyses Outside Regions $A_1$ and $A_2$ (Underscored Alloy Nos. plotted on FIG. 2) | | | | | |
| 595 | 24.0 | 6.0 | 7 | 38 | Failed Test 4 (Bend), Tests 3 & 5 omitted |
| 593 | 24.5 | 6.0 | 14 | 120 | " " |
| 490 | 26.0 | 6.0 | 26 | 108 | Failed Test 4 (Bend), Tests 1, 3 and 5 omitted |
| 494 | 27.0 | 6.0 | 10 | 305 | Failed Test 4 (Bend), Tests 1 and 5 omitted |
| 502 | 28.0 | 6.0 | 9 | 165 | " " |
| 504 | 28.5 | 5.5 | 10 | 160 | Failed Test 5 (S.C.), Test 1 omitted |
| 511 | 29.5 | 5.0 | 11 | 5 | Failed Test 4 (Bend), Tests 1, 3 and 5 omitted |

-continued

| Alloy No. Peripheral | Composition in Per Cent by Wt. Cr and Mo, ppm C and N Cr | Mo | C | N | Remarks |
|---|---|---|---|---|---|
| Analyses Outside Regions $A_1$ and $A_2$ (Underscored Alloy Nos. plotted on FIG. 2) | | | | | |
| 481 | 29.5 | 4.8 | 93 | 88 | Failed Test 5 (S.C.), Test 1 omitted |
| 558 | 33.0 | 5.0 | 22 | 5 | Failed Test 4 (Bend), Tests 3 & 5 omitted |
| 616 | 35.0 | 5.0 | 20 | 203 | Failed Test 4 (Bend), Test 5 omitted |
| 603 | 35.0 | 4.5 | 11 | 115 | Failed Test 4 (Bend), Tests 3 and 5 omitted |

b. Regions $C_1$ and $C_2$ collectively, characterized by resistance to pitting under exposure to (1) permanganate-chloride test, (3) resistance to intergranular corrosion attack (IGA) under exposure to ferric sulfate-sulfuric acid test, (4) ductile in the 180° transverse weld bend test of as-received (unannealed) welded specimens and (5) possessed of stress-corrosion resistance to extent tested. The following specimens all failed Test number 2, the ferric chloride pitting test.

| Alloy No. Regions $C_1$ and $C_2$ (except Alloy 568, which is just below) | Composition in Per Cent by Wt. Cr and Mo, ppm C and N Cr | Mo | C | N | Remarks |
|---|---|---|---|---|---|
| 625 | 27.0 | 4.0 | 15 | 190 | Passed Tests 1, 3 and 4. Not tested for S.C. ( 5) |
| 624 | 26.0 | 3.5 | 17 | 150 | " " |
| 576 | 23.0 | 6.0 | 6 | 43 | Test 3 IGA omitted. Passed S.C. test |
| 571 | 26.5 | 3.0 | 10 | 115 | In addition to Test 2, Test 1 ($KMnO_4$-NaCl) alone run (and passed) |
| 568 | 27.0 | 2.5 | 5 | 120 | Failed Test 1. Tests 3 and 5 omitted |
| 567 | 25.5 | 4.0 | 5 | 75 | In addition to Test 2, Test 1 ($KMnO_4$-NaCl) alone run (and passed) |
| 666 | 22.0 | 6.0 | 52 | 110 | Passed Tests 1, 3 & 4. Not tested for S.C. |
| 597 | 30.0 | 2.0 | 12 | 78 | " " |
| 570 | 28.0 | 2.7 | 13 | 98 | In addition to Test 2 , Test 1 ($KMnO_4$-NaCl) alone run (and passed) |
| 520 | 32.0 | 2.0 | 17 | 50 | Passed Tests 1, 3 & 4. Not tested for S.C. |
| 516 | 31.0 | 2.5 | 7 | 175 | " " |
| 508 | 29.5 | 3.0 | 15 | 163 | Tests 2, 3 & 4 alone run. Failed 2 and 3 (IGA) |
| 457 | 29.0 | 3.0 | 25 | 128 | TEsts 1, 2 & 3 alone run. Failed 2, Passed 1 & 3 |
| 503 | 28.5 | 3.4 | 5 | 160 | Tests 2 3 and 4 alone run. Passed 3 and 4 |
| 435 | 29.0 | 3.0 | 46 | 70 | Passed Tests 1, 3, 4 & 5, failed 2. |

c. Region B, characterized by resistance to pitting under exposure to (1) permanganate-chloride test and (2) ferric chloride test, (3) resistant to intergranular corrosion attack (IGA) under exposure to the ferric sulfate-sulfuric acid test, (4) ductile in the 180° transverse weld bend test of as-received (unannealed) welded specimens and (5) resistant to stress corrosion (S.C.). In addition, all region B and D specimens are passive in boiling 10% $H_2SO_4$ as hereinafter set out in Table IV; however, region D specimens otherwise have the properties of regions $C_1$ and $C_2$, i.e., they fail the ferric chloride Test No. 2.

| Alloy No. Region B | Composition in Per Cent by Wt. Cr and Mo, ppm C and N Cr | Mo | C | N | Remarks |
|---|---|---|---|---|---|
| 631 | 35.0 | 3.5 | 8 | 75 | Passed all 5 tests |
| 606 | 35.0 | 3.5 | 8 | 135 | Passed all 5 tests |
| 556 | 33.0 | 2.5 | 46 | 98 | Passed Tests 1–4, incl. Test 5 (S.C.) omitted |
| 561 | 33.0 | 2.5 | 21 | 18 | 5 (S.C.) omitted |
| 557 | 33.0 | 4.5 | 28 | 35 | Passed Tests 1, 2, 4 and 5. Test 3 (IGA) omitted |
| 555 | 33.0 | 3.0 | 48 | 23 | Test 3 (IGA) omitted |
| 521 | 32.0 | 4.0 | 15 | 45 | Passed Tests 2, 4 & 5. Tests |

-continued

| Alloy No. Region B | Cr | Mo | C | N | Remarks |
|---|---|---|---|---|---|
| | | | | | 1 and 3 (IGA) omitted |
| Region D | | | | | |
| 560 | 33.0 | 2.0 | 16 | 85 | Passed Tests 1, 3 and 4. 5 (S.C.) omitted |

As hereinbefore mentioned in Section B(5), comparative general corrosion resistance to typical common acid environments, including oxidizing, reducing, organic and inorganic acids, is set out in the following Table III:

TABLE III

COMPARISON OF GENERAL CORROSION OF ALLOYS IN ACIDS*
General Corrosion (Boiling)
(mils per year)

| Alloy | Nitric 65% | 50% Sulfuric with Ferric Sulfate | Sulfamic 10% | Formic 45% | Acetic 20% | Oxalic 10% | Sodium Bisulfate 10% | Sulfuric Acid 10% |
|---|---|---|---|---|---|---|---|---|
| AISI 430 | 20 | 312 | 144,000 | 84,700 | 3,000 | 6,400 | 91,200 | 252,000 |
| AISI 446 | 8 | 36 | 150,000 | 9,700 | 0 | 7,000 | 64,800 | 270,000 |
| AISI 304 | 8 | 23 | 1,300 | 1,715 | 300 | 570 | 2,760 | 16,420 |
| AISI 316 | 11 | 25 | 75 | 520 | 2 | 96 | 170 | 855 |
| Carpenter 20 | 8 | 9 | 16 | 7 | 2 | 7 | 11 | 43 |
| Hastelloy C | 450 | 240 | 8 | 5 | 0 | 8 | 8 | 17 |
| Titanium | 1 | 140 | 285 | 873 | 0 | 950 | 250 | 6,290 |
| Fe-28% Cr-4% Mo (1) | 2 | 6 | 0 | 1 | 0 | 13 | 9 | 52,180 |
| Fe-33% Cr-3% Mo (2) | — | — | — | — | — | — | — | 60 |

(1) Alloy Q 202, having C 23 ppm, N 130 ppm
(2) Alloy Q 555, having C 48 ppm, N 23 ppm
*Acid concentrations in per cent by weight The following tests, reported in Table IV, illustrate the critical compositional relationship necessary to achieve the high resistance to boiling 10% sulfuric acid corrosion possessed by alloys lying within regions B and D, FIG. 1.

TABLE IV

CORROSION OF Fe-Cr-Mo ALLOYS IN BOILING 10% SULFURIC ACID

| Alloy No. | Composition Per Cent by Wt. Cr | Mo | ppm C | N | State (1) | Corrosion Rate (2) (mils/yr) |
|---|---|---|---|---|---|---|
| 513 | 30.0 | 4.5 | 19 | 150 | active | 44,200 |
| 539-A | 30.0 | 3.5 | 15 | 128 | active | 195,200 |
| 612 (FIG.2) | 31.0 | 5.0 | 25 | 290 | active | 48,000 |
| 519 | 31.0 | 4.5 | 18 | 100 | active | 53,200 |
| 518 | 31.0 | 4.0 | 21 | 88 | active | 62,500 |
| 627 (FIG.2) | 31.0 | 3.5 | 10 | 265 | active | 72,100 |
| 628 (FIG.2) | 31.5 | 3.0 | 7 | 235 | active | 83,400 |
| 521 | 32.0 | 4.0 | 15 | 45 | passive | 75 |
| 629 | 32.0 | 3.0 | 16 | 75 | passive | 45 |
| 659 | 32.0 | 2.75 | 45 | 140 | passive | 80 |
| 589 (FIG.2) | 32.0 | 2.5 | 22 | 215 | passive | 55 |
| 520 | 32.0 | 2.0 | 17 | 50 | active | 116,000 |
| 484 | 32.0 | 0.0 | 25 | 170 | active | 54,000 |
| 557 | 33.0 | 4.5 | 28 | 35 | passive | 70 |
| 522 | 33.0 | 4.0 | 25 | 53 | passive | 65 |
| 555 | 33.0 | 3.0 | 48 | 23 | passive | 60 |
| 556 | 33.0 | 2.5 | 46 | 98 | passive | 50 |
| 560 | 33.0 | 2.0 | 16 | 85 | passive | 45 |
| 587 | 33.0 | 1.5 | 22 | 195 | passive | 40 |
| 668 (FIG.2) | 35.0 | 4.0 | 39 | 320 | passive | 50 |
| 562 | 35.0 | 3.5 | 14 | 20 | passive | 45 |
| 596 (FIG.2) | 35.0 | 1.0 | 14 | 250 | passive | 45 |

(1) Condition when immersed in the acid. Active = profuse evolution of hydrogen, high corrosion rate. Passive = no visible evolution of hydrogen, low corrosion rate.
(2) Rates on active alloys determined in 5-min. test. Rates on passive alloys determined in 100-hr. test.

The following Table V lists the analyses and test results for a large number of Fe-Cr-Mo alloys which do not meet the compositional limits of this invention, particularly as regards C and N contents. These Alloy Nos. are plotted within the overlay of FIG. 2, and the several causes of test failure are denoted by characteristic point symbols defined in the drawing legend. From Table V, taken in conjunction with FIG. 2, it can be seen that the contents of both C and N are sharply critical, and that this criticality is also affected, to some degree, by the associated Cr and Mo.

TABLE V

FIG. 2 DATA
TEST RESULTS

| ALLOY NO. | COMPOSITIONS IN WT. PER CENT Cr & Mo | | PPM C AND N | | $KMnO_4$-NaCl Test 1 | $FeCl_3$ Test 2 | $Fe_2(SO_4)_3$-$H_2SO_4$ Test 3 | | | BEND TEST 4 | STRESS CORROSION TEST 5 |
|---|---|---|---|---|---|---|---|---|---|---|---|
| | Cr | Mo | C | N | | | HAZ | WELD | BP | | |
| 529 | 27.5 | 4.2 | 16 | 208 | P | P | P | P | P | P | P |
| **532 | 28.5 | 4.5 | 24 | 353 | P | P | F | P | P | P | P |
| 627 | 31.0 | 3.5 | 10 | 265 | P | P | P | P | P | | P |
| 668 | 35.0 | 4.0 | 39 | 320 | P | P | P | P | P | P | — |
| 493 | 27.0 | 5.5 | 20 | 223 | — | P | P | P | P | P | P |
| 453 | 29.0 | 4.0 | 18 | 239 | — | P | P | P | P | P | P |
| 492 | 27.0 | 5.0 | 10 | 283 | — | P | P | P | P | P | F |
| 628 | 31.5 | 3.0 | 7 | 235 | P | P | F | P | P | P(F)* | — |
| 612 | 31.0 | 5.0 | 25 | 290 | P | P | P | P | P | F | — |
| 615 | 35.0 | 2.5 | 23 | 100 | P | F | P | P | P | F | — |
| 630 | 35.0 | 3.5 | 7 | 185 | P | P | P | P | P | F | — |
| 657 | 28.5 | 4.0 | 56 | 198 | P | P | P | P | P | F | — |
| 458 | 28.5 | 4.0 | 114 | 208 | — | P | F | F | P | P | F |
| 459 | 28.5 | 4.0 | 118 | 65 | — | F | P | F | F | P | F |
| 599 | 33.0 | 3.0 | 109 | 68 | P | F | F | F | P | P | P |
| 494 | 27.0 | 6.0 | 10 | 305 | — | P | P | P | P | F | — |
| 613 | 34.0 | 2.0 | 26 | 300 | P | F | P | P | P | F | — |
| 497 | 28.0 | 3.5 | 29 | 209 | — | F | F | P | P | P | — |
| 594 | 25.0 | 5.0 | 18 | 268 | P | F | F | P | P | F | — |
| 463 | 28.5 | 4.0 | 14 | 239 | — | F | P | P | F | F | — |
| 409B | 29.0 | 4.7 | 856 | 219 | P | F | F | F | P | F | — |
| 450 | 27.5 | 3.0 | 14 | 204 | P | F | P | F | F | — | — |
| 452 | 28.5 | 3.0 | 33 | 267 | P | F | F | F | P | — | — |
| 460 | 28.5 | 4.0 | 171 | 70 | P | F | F | F | F | P | F |
| 464 | 28.5 | 4.0 | 22 | 239 | P | F | F | P | P | F | — |
| 487 | 26.0 | 1.0 | 26 | 204 | — | F | F | F | F | P | P |
| 589 | 32.0 | 2.5 | 22 | 215 | P | F | F | F | P | F | — |
| ***531 | 28.5 | 4.5 | 334 | 25 | P | F | F | F | F | F | — |
| 461 | 28.5 | 4.0 | 189 | 89 | P | F | F | F | F | F | — |
| 582 | 27.0 | 3.0 | 48 | 255 | F | F | F | P | P | P | P |
| 587 | 33.0 | 1.5 | 22 | 195 | F | F | P | P | P | F | — |
| 530 | 26.0 | 1.0 | 15 | 90 | F | F | F | F | P | P | P |
| 408 | 29.0 | 4.7 | 48 | 372 | — | — | F | F | F | F | — |

* Second sample
** Deficiency cured by heating 1 hr. at 2000°F. and water quenching.
*** Deficiency not cured by heating 1 hr. at 2000°F. and water quenching.
(—not tested)
(P—Passed)
(F—failed)

D. SUMMARY

From the foregoing, it will be seen that the alloys of my invention have post-welding ductility and good stress corrosion resistance besides being, 1. In area A, made up of regions $A_1$ and $A_2$, collectively, extremely resistant to pitting corrosion as regards both Tests number 1, permanganate-chloride, and number 3, ferric-chloride, 2. In area C, made up of regions $C_1$ and $C_2$, collectively, highly resistant to pitting corrosion as regards Test number 1, 3. In region B, equally resistant as area A, plus passive and resistant to corrosion in boiling 10% $H_2SO_4$, 4. In region D, equally resistant as collectively, C, plus passive and resistant to corrosion in boiling 10% $H_2SO_4$.

Outside of areas A and C and regions B and C, taken together, Fe-Cr-Mo alloys are deficient in one or more respects. For example, below region C the alloys suffer both serious pitting corrosion in the less severe Test number 1 (permanganate-chloride exposure) and may also be subject to intergranular attack, with resultant grain dropping, although they may be ductile after welding.

Below region D, the alloys suffer not only pitting corrosion and intergranular attack but are also brittle after welding. To the right of regions B and D, the alloys are brittle after welding, whereas, above area A and region B, the alloys are either brittle, so that they break during bending after welding, or otherwise they crack during the stress corrosion test.

The lines of demarcation of the regions are surprisingly sharp, a change of less than 0.1% Mo or Cr producing the critical change in pitting resistance from good to bad, or from acceptance to rejection.

As regards the Alloys of FIG. 2, most of the specimens failed by intergranular corrosion attack, although some also failed in the pitting corrosion test, were brittle after welding, or failed by stress corrosion.

E. ADDITION OF OTHER METALS TO Fe-Cr-Mo ALLOYS

In order to determine possible benefits of other additives, a number of specimens were made up containing 28–29% Cr, 4–4.5% Mo, plus single metals in the ranges set forth in Table VI. The specific purposes for which the several additions were made are indicated, together with a brief report of side effects noted.

TABLE VI

| Component and Amounts | Purpose | Achievement of Purpose-Other Effects |
|---|---|---|
| Aluminum | Grain refiner | Yes |

TABLE VI-continued

| Component and Amounts | Purpose | Achievement of Purpose-Other Effects |
|---|---|---|
| 0.10 – 0.60% Titanium or Niobium 0.20 – 0.60% | a) To prevent IGA b) Grain refiner | a) No. I.G.A. above invention's specified C, N limits. Bend cracking tendency increased. b) Yes. Grain was refined |
| Platinum 0.006 – 0.30% | Field $A_2$ – $C_2$ passivity in boiling 10% $H_2SO_4$ | Yes. Continued region $A_2$, $C_2$ properties |
| Palladium 0.02 – 0.20% | Passivity in boiling 10% $H_2SO_4$ | Yes. Lost pitting resistance in both Tests 1 and 2 |
| Iridium 0.015 – 0.10% | " | Yes. Continued region $A_2$ + $C_2$ properties |
| Rhodium 0.005 – 0.10% | " | Yes. Resistant in Test 1 but not in Test 2. One sample, near the N limit of 200 ppm showed I.G.A. |
| Osmium 0.02 – 0.10% | " | Yes. Osmium oxide has high vapor pressure and is toxic. Continued $A_2$, $C_2$ properties. |
| Ruthenium 0.020 – 1.50% | " | Yes. No deleterious effects observed up to 0.30% Ru. Suffered stress corrosion above 0.30% level. |
| 0.02% Ruthenium + 0.30% Aluminum | Passivity in boiling 10% $H_2SO_4$ | Yes. No deleterious effects observed. Grain refinement noted. |
| 0.01% Ruthenium + 0.20% Nickel | " | Yes. Region $A_2$ requirements met, and no stress corrosion on welded specimen despite Ni. |
| 0.20% Gold | " | Yes. Resistant in Test 1, but not Test 2. |
| Nickel 0.25 to 2.0% | " | Yes. Stress corrosion resistance progressively decreases as nickel content increases. |
| Nickel 2.0–3.0% | " | Yes. Self-repassivating, and resistant in Test 1, but not Test 2. |
| Cobalt 2.0 – 4.0% | " | Yes. Stress corrosion resistance seriously decreased. Not resistant in Test 2. |
| Addition of silicon in range 1.5 – 2.0% to alloys containing 27–30% Cr and 1.5 – 2.0% Mo. | Mo replacement | Yes. Resistant in Tests 1 and 2. |
| 0.80% Mn + 0.50% Si | Commonly present in commercial heats. | Yes. No harm done to any Region $A_2$ properties. |
| 0.20% Cu or 0.15% Ni, singly, or 0.10% Cu + 0.10% Ni | Commonly present in commercial heats. | Yes. No harm done to Region $A_2$ properties. |

The research work culminating in the data set out in Table VI showed that additives in quantities less than the minima reported for individual ranges were ineffective in producing the desired results.

For the additions of ruthenium and nickel, respectively, the entries of Table VI are expanded as Tables VII and VIII, where the individual results for several samples are shown. In addition, these Tables show the self-repassivating effect obtained when sufficient of eitehr additive, Ru or Ni, respectively, is present.

TABLE VII

EFFECT OF RUTHENIUM ADDITIONS TO Fe - 28% Cr - 4% Mo Alloy

| | | Behavior in Boiling 10% $H_2SO_4$ | | Pitting Corrosion | | Stress Corrosion (3) |
|---|---|---|---|---|---|---|
| Alloy No. | Ruthenium Addition (% by Weight) | State | Corrosion Rate (mils/year) | $KMnO_4$-NaCl(1) | $FeCl_3$(2) | (Boiling 45% $MgCl_2$) |
| 338 | 0.015 | active | 62,200 | — | — | — |
| 477-A | 0.017 | active | — | — | P | — |
| 334 | 0.020 | passive | 60 | P | P | Resistant (not welded) |
| 542 | 0.20 | passive | 9 | — | P | — |
| 475 | 0.30 | passive | 2 | P | P | Resistant (welded) |
| 683 | 0.50 | passive* | 7 | — | P | Failed (welded) |
| 671 | 0.75 | passive* | 2 | P | P | Failed (welded) |
| 684 | 1.50 | passive* | 2 | P | P | Failed (welded) |

TABLE VII-continued

EFFECT OF RUTHENIUM ADDITIONS TO Fe - 28% Cr - 4% Mo Alloy

| | | Behavior in Boiling 10% $H_2SO_4$ | | Pitting Corrosion | | Stress Corrosion (3) |
|---|---|---|---|---|---|---|
| Alloy No. | Ruthenium Addition (% by Weight) | State | Corrosion Rate (mils/year) | $KMnO_4$-NaCl(1) | $FeCl_3$(2) | (Boiling 45% $MgCl_2$) |
| 476-A | 0.010 plus 0.20 Ni | passive | 40 | P | P | Resistant (welded) |

*self-repassivating
(1)2% $KMnO_4$ — 2% NaCl at 90°C.
(2)10% $FeCl_3.6\ H_2O$ at 50°C. with crevices.
(3)Magnesium chloride test.
P = No pitting
— = Not tested

TABLE VIII

EFFECT OF NICKEL ADDITIONS TO Fe - 28% Cr - 4% Mo ALLOY

| | | Behavior in Boiling 10% $H_2SO_4$ | | Pitting Corrosion | | |
|---|---|---|---|---|---|---|
| Alloy No. | Nickel Addition, (% by Weight) | State | Corrosion Rate (mils/year) | $KMnO_4$-NaCl(1) | $FeCl_3$(2) | Stress Corrosion(3) |
| 436 | 0.00 | active | 52,000 | P | P | Resistant (welded) |
| 677 | 0.10 | active | 63,000 | P | P | Resistant (welded) |
| 239 | 0.20 | active | — | P | P | Resistant |
| 217 | 0.25 | passive | 56 | P | P | Failed (welded) |
| 183 | 0.30 | passive | 52 | P | P | Failed after 119 hours |
| 191 | 0.40 | passive | 29 | P | P | Failed after 261 hours |
| 241 | 0.50 | passive | 24 | P | P | Failed after 16 hours |
| 245 | 1.50 | passive | 6 | P | P | Failed in less than 16 hrs. |
| 681 | 1.80 | passive | 11 | P | P | — |
| 664 | 2.00 | passive* | 8 | P | P | — |
| 658 | 2.50 | passive* | 10 | P | F | — |
| 649 | 3.00 | passive* | 9 | P | F | — |

*These alloys are also self-repassivating.
Footnotes for Table VIII
(1)2% $KMnO_4$ — 2% NaCl at 90°C.
(2)10% $FeCl_3.6\ H_2O$ at 50°C. with crevices.
(3)Magnesium chloride test on unwelded specimens except as noted.
P = Passed
F = Failed
— = Not tested The effectiveness of nickel in conferring passivity in $H_2SO_4$ is a function of both chromium and molybdenum, as shown in TABLE IX. Thus, positive benefits accrue above a molybdenum content of about 2.0% and with the approximate lower essential limit for chromium 27.5%, thereby locating the broken vertical line of demarcation setting off area $A_2$ from $A_1$ and $C_2$ from $C_1$ in FIG. 1.

In addition, as indicated by Alloy No. 634 in TABLE IX, alloys containing the specified minimum of ruthenium appear to require the same 27.5% minimum chromium.

TABLE IX

EFFECT OF NICKEL AND RUTHENIUM ADDITIONS TO Fe-Cr-Mo ALLOYS

| | Composition (1) | | | Boiling 10% Sulfuric Acid | Pitting Corrosion | | Stress Corrosion (4) |
|---|---|---|---|---|---|---|---|
| Alloy | Cr | Mo | Nickel | State | $KMnO_4$-NaCl (2) | $FeCl_3$(3) | (not welded) |
| Q-231 | 25.0 | 4.0 | 0.40 | active | F | F | Failed after 447 hrs. |
| Q-232 | 26.0 | 4.0 | 0.40 | active | P | F | Resistant |
| Q-233 | 27.0 | 4.0 | 0.40 | active | P | F | Failed after 447 hrs. |
| Q-632 | 26.0 | 1.0 | 0.25 | active | F | F | — |
| Q-191 | 28.0 | 4.0 | 0.40 | passive | P | P | Failed after 261 hrs. |
| Q-196 | 28.5 | 0.0 | 0.40 | active | F | F | — |
| Q-195 | 28.5 | 1.0 | 0.40 | active | F | F | — |
| Q-194 | 28.5 | 2.0 | 0.40 | passive | F | F | — |
| Q-193 | 28.5 | 3.0 | 0.40 | passive | P | F | — |
| Q-192 | 28.5 | 3.5 | 0.40 | passive | P | P | — |
| | | | Ruthenium | | | | |

TABLE IX-continued

EFFECT OF NICKEL AND RUTHENIUM ADDITIONS TO Fe-Cr-Mo ALLOYS

| | Composition (1) | | | Boiling 10% Sulfuric Acid | Pitting Corrosion | | Stress Corrosion (4) |
|---|---|---|---|---|---|---|---|
| Alloy | Cr | Mo | Nickel | State | $KMnO_4$-NaCl (2) | $FeCl_3$(3) | (not welded) |
| Q-634 | 26.0 | 1.0 | 0.02 | active | F | F | — |

(1)Per cent by weight.
(2)2% $KMnO_4$ – 2% NaCl at 90°C.
(3)10% $FeCl_3.6\ H_2O$ at 50°C. with crevices.
(4)Magnesium chloride test on unwelded specimen.
P = resistant
F = Pitted The research on additives of Table VI indicates that:

1. Aluminum can be added up to 0.60% to the compositions of this invention in order to obtain grain refinement, 2. Titanium and niobium, in contrast with the opposite expectation based on prior art, where not effective in my Fe—Cr—Mo—containing alloys to fix excessive C or N, although they did produce a grain refinement similar to that obtained with Al.

3. The noble metals aided regin $A_2$ compositions to achieve passivity in boiling 10% $H_2SO_4$, but palladium especially, and rhodium to a lesser degree, reduced the pitting corrosion resistance. Of the noble metals, ruthenium is especially attractive becausee of moderate cost, effectiveness in small amounts, and freedom from loss in pitting corrosion resistance.

4. Nickel is effective in producing passivation, but the quantities requiring make the alloys prone to stress corrosion cracking in $MgCl_2$ solution. However, 0.01% Ru + 0.20% Ni provided passivation without loss of stress corrosion resistance.

5. Nickel in the range of 2.0–3.0% causes the alloy to acquire the property of self-repassivation (refer Table VIII). There is, however, accompanying loss in pitting resistance in the ferric chloride test, and in the magnesium chloride stress corrosion test.

6. In alloys containing 27–30% Cr and 1.5–2.0% Mo minima, it is feasible to obtain enhanced corrosion resistance (i.e., the properties of Region $A_2$) by additions of 1.5–2.0% Si.

What is claimed is:

1. A corrosion-resistant ferritic iron-chromium-molybdenum alloy having good post-welding ductility consisting essentially of chromium and molybdenum in the weight percentages within areas $A_1$, $A_2$, B, $C_1$, $C_2$ and D of FIG. 1, carbon 100 ppm maximum, nitrogen 200 ppm maximum, and carbon plus nitrogen 250 ppm maximum, the balance being iron and incidental impurities.

2. A corrosion-resistant ferritic iron-chromium-molybdenum alloy according to claim 1 incorporating 28.5–30.5% Cr and 3.5–4.5% Mo.

3. A corrosion-resistant ferritic iron-chromium-molybdenum alloy according to claim 1 wherein said chromium and molybdenum are incorporated in weight percentages within areas $A_1$ and $A_2$ of FIG. 1.

4. A corrosion-resistant ferritic iron-chromium-molybdenum alloy according to claim 1 wherein said chromium and molybdenum are incorporated in weight percentages within area B of FIG. 1.

5. A corrosion-resistant ferritic iron-chromium-molybdenum alloy according to claim 4 incorporating 32–34% Cr and 2.75–3.75% Mo.

6. A corrosion-resistant ferritic iron-chromium-molybdenum alloy according to claim 1 wherein said chromium and molybdenum are incorporated in weight percentages within areas $C_1$ and $C_2$ of FIG. 1.

7. A corrosion-resistant ferritic iron-chromium-molybdenum alloy according to claim 1 wherein said chromium and molybdenum are incorporated in weight percentages within area D of FIG. 1.

8. A corrosion-resistant ferritic iron-chromium-molybdenum alloy according to claim 1 wherein said chromium and molybdenum are incorporated in weight percentages within areas $A_1$, $A_2$, B, $C_1$, $C_2$ and D of FIG. 1, including, additionally, up to 1% Mn and up to 1% Si.

* * * * *

UNITED STATES PATENT OFFICE

CERTIFICATE OF CORRECTION

PATENT NO. : 3,932,175

DATED : January 13, 1976

INVENTOR(S) : Michael A. Streicher

It is certified that error appears in the above-identified patent and that said Letters Patent are hereby corrected as shown below:

Col. 1, line 46, after "4%" add --C--.
Col. 1, line 58, "to" should read --of--.
Col. 2, line 19, "Bue" should read --But--.
Col. 4, line 21, delete "119".
Col. 5, line 68, "polymet" should read --polymer--.
Col. 6, line 29, "0.336" should read --0.366--.
Col. 6, line 45, "$Cl^+$" should read --$Cl^-$--.
Col. 8, line 22, after "C 29 ppm," add --N 65 ppm--.
Col. 10, under "Alloy No." in last table, the numeral 494 should be underscored.
Col. 11, under "Alloy No." in the top table, the numeral 616 should be underscored.
Col. 16, in TABLE V, under BEND TEST 4 data, the data for Alloy No. 627 should be entered as --P--.
Col. 15, line 47, "3" should read --2--.
Col. 15, line 53, "collectively" should read --area--.
Col. 18, line 53, "eitehr" should read --either--.
Col. 19, in notes re TABLE VIII at end thereof, "P = Passed" should read --P = Passed, no pitting--; and "F = Failed" should read --F = Failed, pitted--.
Col. 21, line 23, "regin" should read --region--.
Col. 21, line 27, "becausee" should read --because--.
Col. 21, line 31, "requiring" should read --required--.

Signed and Sealed this twenty-second Day of June 1976

[SEAL]

Attest:

RUTH C. MASON
Attesting Officer

C. MARSHALL DANN
Commissioner of Patents and Trademarks